United States Patent [19]

Fast

[11] Patent Number: 4,715,135

[45] Date of Patent: Dec. 29, 1987

[54] LONGITUDINALLY REINFORCED DISPLAY TAG FOR PRODUCT INFORMATION

[76] Inventor: Jacob Fast, 7561 NW. 9th St., Plantation, Fla. 33317

[21] Appl. No.: 876,167

[22] Filed: Jun. 19, 1986

[51] Int. Cl.[4] ..... G09F 1/00

[52] U.S. Cl. ..... 40/10 R; 40/20 R

[58] Field of Search ..... 40/20 R, 10 R, 16; 428/194

[56] References Cited

U.S. PATENT DOCUMENTS 3,189,185 6/1965 Grasso .
3,483,995 12/1969 Larson .
3,912,084 10/1975 Valiulis .
4,140,224 2/1979 Celeste ..... 40/10 R
4,525,944 7/1985 Fast .

*Primary Examiner*—Henry E. Raduazo
*Attorney, Agent, or Firm*—Holman & Stern

[57] ABSTRACT

Elongate product information and display tag blanks of plastic sheet material are disclosed having a mounting portion for securing the blank at a proximal end of a horizontally extending support hook, an elongate portion adjacent the mounting portion for extending over the hook to present product information at a distal end thereof, and longitudinal reinforcement, in the form of rows of perforations or lengthwise creases extending at least along the elongate portion of the blank for strengthening it against lengthwise flexure or sagging.

9 Claims, 11 Drawing Figures

10
10a
12
12a
14
14a
14b
14c
14d
16
18
20
22
22a
22b
24
24a
26
2
4
5

12b
16b
10b
14b
28
8
8
24b
20b
18b
14b
28
12c
10
10
22c
22c
14g
10c
14c
14e
28a
14f
22c
24c
22c
26c
22c
14g
22c
28a
12c
B
S
14g
22c
22c
14e
10c
28a

LONGITUDINALLY REINFORCED DISPLAY TAG FOR PRODUCT INFORMATION

BACKGROUND OF THE INVENTION

The invention relates to product identification and information display tags for merchandise suspended from horizontally extending support hooks and the like. More particularly, the invention relates to such tags which are easily attached to and removed from support hooks without being subject to inadvertent removal, and which display product information forwardly of the supported merchandise.

I have, in recent years, developed a range of product display tags of the above type for use with different types of support hooks, the tags in general being formed from plastic sheet so as to provide a mounting portion which attaches to a support hook at the back or proximal end of the hook, and an elongate portion which extends forwardly over the support hook (and the products suspended thereon) for presenting product information at the forward or distal end of the support hook. The product information may, for example, be provided on a label secured to a downwardly depending display portion of the tag located forwardly with respect to the distal end of the support hook so that the product information is conveniently displayed to a consumer or the like at a location forwardly of the merchandise. With display tags of this nature, when a product is to be removed from the support hook, the tag may be flexed upwardly and may fall back into position after the product has been released from the hook.

Since product information and display tags of the above type are generally only mounted on the support hook at the rear or the proximal end of the tag, the longer the tag, the more it tends of sag (flex longitudinally) under its own weight and generally become less stable laterally and longitudinally so that the tag may not present a sufficiently stable surface at its forward end for effective scanning of the product information, by a bar code reader for example. It is accordingly an object of the present invention to provide a tag of the type described which has improved stability at least against longitudinal and/or lateral flexure thereof.

SUMMARY OF THE INVENTION

In accordance with the invention, in an elongate product information and display tag blank of plastic sheet having a mounting portion for releasably securing the blank at a proximal end of a horizontally extending support hook or the like and an elongate portion adjacent the mounting portion for extending over the hook to present product information at a distal end thereof, there is provided longitudinal reinforcing means for the blank extending at least along the elongate portion thereof, the strengthening means preferrably comprising longitudinal rows of perforations or longitudinally extending ribbing. The longitudinal strengthening means promotes transverse flexure of the elongate portion of the blank into a bowed configuration and effectively reinforces the blank against longitudinal and lateral flexure.

The longitudinal perforations or creases, as the case may be, may readily be provided in the blank during manufacture with conventional perforating or rotary creasing machinery. A perforated blank may be squeezed laterally to provide the bowed configuration which reinforces the blank against longitudinal flexure and in the case of a longitudinally creased blank the creasing process itself may be effective transversely to bow the blank but if necessary the bowed configuration may be suplemented by lateral squeezing.

Longitudinal reinforcement of the blank as described above enables at least the elongate portion thereof to be reduced in width as compared with the respective end portions of the blank one of which constitutes the mounting portion. The width reduction, moreover, not only economizes on blank material but also has a further beneficial effect. Plastic product information and display tags of the kind described have a tendency to collect dust by static cling and become unsightly after a period of use. The reduced width of the elongate portion which is allowed by the longitudinal reinforcing of the blank reduces the area available for dust collection and moreover, the longitudinal perforations or creases have the further effect of disguising what dust collection there is.

Additional features and advantages of the invention will become apparent from the following description and claims read in conjunction with the attached drawings.

DESCRIPTION OF PREFERRED EMBODIMENTS

Figures 1, 2, 3, 4, 5, 6:
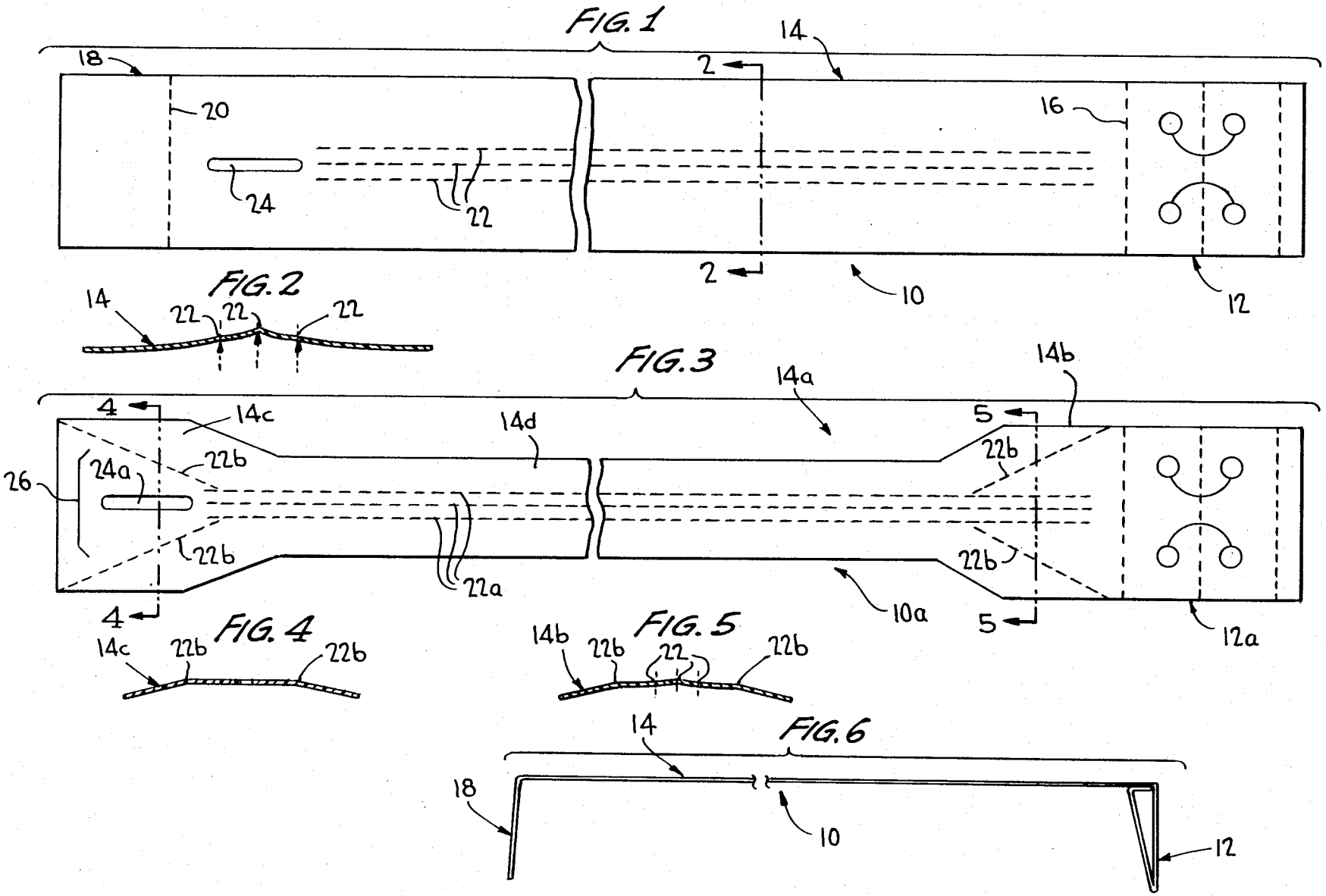
FIG. 1 is a plan view of a first embodiment product information and display tag blank in accordance with the invention.
FIG. 2 is an enlarged sectional view on line 2—2 of FIG. 1.
FIG. 3 is a plan view of a second embodiment product information and display tag blank in accordance with the invention.
FIG. 4 is an enlarged sectional view on line 4—4 of FIG. 3.
FIG. 5 is an enlarged sectional view on line 5—5 of FIG. 3.
FIG. 6 is an elevational view of the blank folded into its tag-forming configuration.
Figures 7, 8, 9, 10, 11:
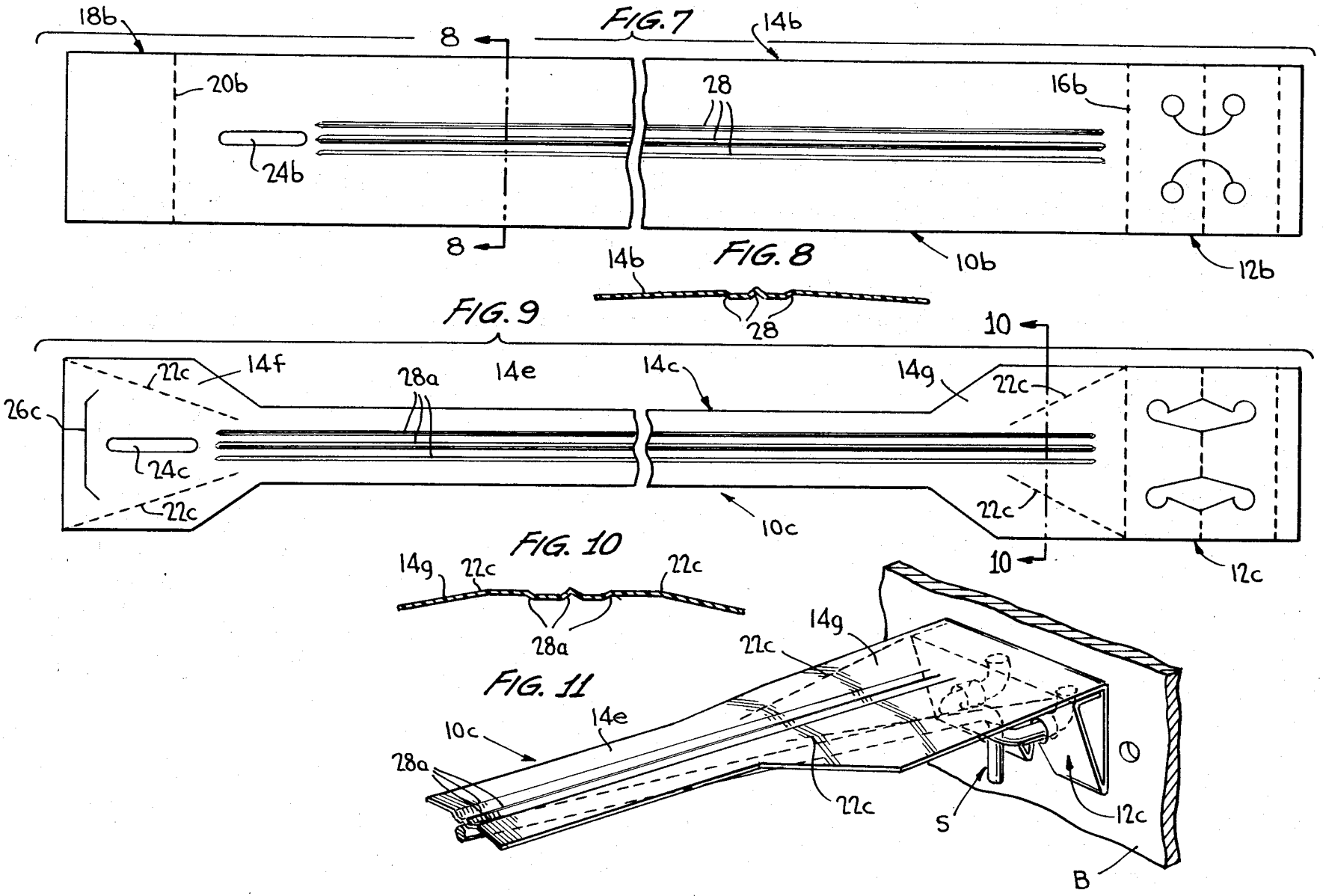
FIG. 7 is a plan view of a third embodiment product information and display tag blank in accordance with the invention.
FIG. 8 is an enlarged sectional view on line 8—8 of FIG. 7.
FIG. 9 is a plan view of a fourth embodiment product information and display tag blank in accordance with the invention.
FIG. 10 is an enlarged sectional view on line 10—10 of FIG. 9.
FIG. 11 is a perspective view of a proximal end portion of the blank shown in FIGS. 9 and 10 after it is folded to form the tag and mounted on a product support hook.

Referring initially to FIGS. 1 and 2, there is shown a product information and display tag blank 10 diecut from plastic sheet material and formed at a proximal end thereof with a mounting portion 12 for securing the blank at the proximal end of a product support hook or the like when the mounting portion is suitably folded, an elongate portion 14 adjacent the mounting portion, for extending over the support hook, portions 12 and 14 being separated by a transverse fold line 16, and a product information and display portion 18 at a distal end of the blank separated from elongate poriton 14 by another transverse fold line 20. In use, the mounting portion 12 of the blank and the product information portion 18 are folded generally as shown in FIG. 6 and the tag thus formed may, for example, be mounted on a support hook structure such as structure S extending from a perforated board B as shown in FIG. 11. The particular configuration of mounting portion 12 as shown in FIG. 1, is of a type disclosed in my U.S. Pat. No. 4,525,944, issued July 2, 1985 and which is particularly adapted for support hook structures of the type shown in FIG. 11. However, it is understood that the mounting portion 12 shown in FIG. 1 is by way of example only and tag blanks in accordance with the invention may have a variey of differently configured mounting portions dependent on the particular application for which the blank is to be used. Further, FIGS. 1 and 6 show a product information and display portion 18 which is integral with elongate portion 14. However, as discussed below, the blank could alternatively be configured for use with a detachable product information and display portion.

Reverting to FIGS. 1 and 2, it will be seen that elongate portion 14 of the blank is provided substantially centrally of its width with three lengthwise extending rows 22 of perforations. The perforations extend substantially along the entire length of the elongate portion but terminate just short of an elongate diecut slot 24 at the distal end which is provided for the distal end of a support hook to extend through in known manner.

The longitudinal perforations 22 may be formed by conventional perforating machinery and enable the elongate portion 14 of the blank to be squeezed laterally into a somewhat bowed configuration as shown in FIG. 2. This bowing of the blank effectively reinforces same against longitudinal flexure or sagging thereof when it is folded into its tag-forming configuration and also to an extent resists lateral flexure of the tag thereby stabilizing same in use.

The longitudinal reinforcement of the elongate portion of the tag blank provided by the longitudinal rows of perforations, and transverse bowing of the blank, allows the elongate portion of the blank to be reduced in width while maintaining its resistance to longitudinal and lateral flexure. A reduced width tag blank **10*a* of similar general form to tag blank 10 is shown in FIGS. 3, 4, and 5. Blank 10*a*, has a mounting portion 12*a* of like configuration to portion 12 of blank 10, an elongate portion 14*a* which, in this case, is of somewhat longer length than portion 14 and is provided at its forward end with a transverse slit 26 for attachment of a separate product information and display element of the type, for example, disclosed in by copending patent application Ser. No. 719,116 filed Apr. 12, 1985. Also, it will be noted that elongate portion 14*a* of the blank in this case has full-width end sections 14*b*, 14*c* and a reduced-width central section 14*d*. Rows of longitudinal perforations 22*a* are again provided along the length of the elongate portion for providing reinforcement by bowing thereof as previously described and the blank may further include outwardly flared lines of perforations 22*b*** in the full width end sections of the elongate portion. The flared portions, however, are not considered essential for adequate longitudinal reinforcement of the blank.

FIGS. 7 and 8 show a third embodiment blank **10*b* in accordance with the invention which is in all respects similar to blank 10 shown in FIGS. 1 and 2 except that the longitudinally extending lines of perforations 22 in FIGS. 1 and 2 are in this case replaced by longitudinally extending reinforcing ribs 28** which are defined by lengthwise creases in the plastic sheet which are formed in a rotary type creasing machine, known per se, having a bed with projecting fingers and a corresponding rotary cylinder with interposed projections which cooperate with the fingers to form the respective creases.

The longitudinal reinforcing creases 28 may inherently provide the elongate portion **14*b* of blank 10*b* with a somewhat bowed effect as shown in FIG. 8 or further bowing may be achieved by squeezing the blank laterally as in the previous embodiments. As previously, the creasing and bowing of the elongate section 14*b*** reinforces the blank against longitudinal and lateral flexure.

FIGS. 9 and 10 shows a fourth embodiment blank **10*c* in accordance with the invention which is in all respects similar to blank 10*a* shown in FIGS. 3 through 5 execpt, again, that the longitudinal rows of perforations 22*a* in blank 10*a* are replaced by longitudinal reinforcing ribs 28*a* in the form of creases of like construction to the creases 28 in FIGS. 7 and 8. In other respects, blank 10*c* is similar to blank 10*a*, with a somewhat modified mounting portion 12*c* of another kind shown, for example, in the above noted U.S. patent. Thus, elongate portion 14*c* of the blank has a reduced width central section 14*e* and full width end sections 14*f* and 14*g*. Fled rows of perforations 22*c* are again provided, although, as previously referred to, these are not considered essential for blank reinforcement. FIG. 11 shows a distal end section of blank 10*c*** after it has been folded to form a product information and display tag and attached to hook structure S supported on a perforated board B.

In each form of the invention as hereinbefore described, the respective blanks are provided with effective longitudinal strengthening means in the form of rows of perforations or creased ribs which promote transverse flexure of the blank into a bowed configuration resisting longitudinal flexure or sagging and lateral flexure when the blank is used as an information display tag in conjunction with a support hook. Further, the embodiments shown respectively in FIGS. 3 and 9 having a reduced width central section for the elongate portion which extends a substantial length of the tag thereby economizing in material and minimizing the area available for dust collection. Reference may here be made to my copending applicatiion on entitled "Product Information Display Tag", which is filed concurrently herewith, and which shows a longitudinally reinforced tag having mouting portion particularly adapted for securing the tag on a "skyhook" type of hook structure. The content of the copending application is also expressly incorporated herein by reference.

While only perferred embodiments of the invention have been described herein in detail, the invention is not limited thereby and modifications can be made within the scope of the attached claims.

What is claimed is:

1. An elongated product information and display tag blank of plastic sheet having a mounting portion for releasably securing the blank at a proximal end of a horizontally extending support hook or the like, a substantially flat elongate portion adjacent the mounting portion for extending over the hook to present product information at a distal end thereof and lengthwise strengthening means extending at least along the elongate portion of the blank for promoting transverse flexure of the elongate portion into a bowed congfiguration when the elongate portion is, squeezed laterally there by reinforcing the blank against longitudinal flexure.

2. The invention as defined in claim 1 wherein the strengthening means comprises lengthwise rows of perforations.

3. The invention as defined in claim 1 wherein the strengthening means comprises a plurality of lengthwise strengthening ribs.

4. The invention as defined in claim 3 wherein the ribs are defined by creases in the plastic sheet.

5. An elongate product information and display tag blank of plastic sheet having a mounting portion for releasably securing the blank at a proximal end of a horizontally extending support hook or the like, a substantially flat elongate portion adjacent the mounting portion for extending over the hook to present product information at a distal end thereof and lengthwise strengthening means extending at least along the elongate portion of the blank for promoting transverse flexure of the elongate portion into a bowed configuration when the elongate portion is, squeezed laterally there by reinforcing the blank against longitudinal flexure wherein the elongate portion has relatively larger-width end sections and a relatively narrower-width central section, and wherein the strengthening means extends at least along the central section.

6. The invention as defined in claim 5 wherein the strengthening means extends into the respective end sections.

7. The invention as defined in claim 5 wherein the strengthening means comprises lengthwise rows of perforations.

8. The invention as defined in claim 5 wherein the strengthening means comprises a plurality of lengthwise strengthening ribs.

9. The invention as defined in claim 8 wherein the ribs are defined by creases in the plastic sheet.

* * * * *